US006998585B2

(12) United States Patent
Erdmann

(10) Patent No.: US 6,998,585 B2
(45) Date of Patent: Feb. 14, 2006

(54) CONTROL UNIT FOR A HOUSEHOLD APPLIANCE

(75) Inventor: Klaus Erdmann, New Bern, NC (US)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/897,641

(22) Filed: Jul. 23, 2004

(65) Prior Publication Data

US 2004/0262291 A1 Dec. 30, 2004

(30) Foreign Application Priority Data

Jan. 23, 2002 (DE) ..... 102 02 493
Jan. 20, 2003 (WO) ..... PCT/EP03/00508

(51) Int. Cl.
*H05B 1/02* (2006.01)

(52) U.S. Cl. ..... 219/490; 219/494; 219/508; 219/443.1; 219/448.12

(58) Field of Classification Search ..... 219/506, 219/490, 494, 497, 702, 714, 443.1, 446.1, 219/448.12, 476, 508
See application file for complete search history.

(56) References Cited

U.S. PATENT DOCUMENTS

| | | | | |
|---|---|---|---|---|
| 3,632,983 | A * | 1/1972 | Dills | 219/452.12 |
| 4,131,786 | A * | 12/1978 | Cooper | 219/487 |
| 5,717,189 | A | 2/1998 | Goetz et al. | |
| 5,920,131 | A | 7/1999 | Platt et al. | |
| 6,198,079 | B1 * | 3/2001 | Essig | 219/497 |
| 2004/0018827 | A1 * | 1/2004 | Laaser | 455/402 |

FOREIGN PATENT DOCUMENTS

DE 296 20 199 U1 9/1997

* cited by examiner

*Primary Examiner*—Mark Paschall

(74) *Attorney, Agent, or Firm*—John T. Winburn; Russell W. Warnock; Craig J. Loest

(57) ABSTRACT

A control unit for a household appliance, preferably a cooking device, containing a control device and regulating devices. The control device has a removable control element and a blocking device. The regulating devices have a change-over regulating device that allows the cooking device to be used in an alternative operating mode should the control element be removed from the cooking device.

15 Claims, 2 Drawing Sheets

CONTROL UNIT FOR A HOUSEHOLD APPLIANCE

The invention relates to a control unit for a household appliance, preferably a cooking surface according to the preamble of claim 1.

Glass ceramic cooking surfaces with control units of this type are on the market. These have a glass ceramic plate with four hot plates for example and an actuating panel. Regulating devices in the form of contact switches are arranged in the actuating panel, with sensors on the underside of the plate which respond to contact of the upper side of the plate by the operator. Various operating states of the cooking surface can be adjusted using these regulating devices. They are used for example, to pre-select the hot plate to be adjusted or to adjust the heated area of the hot plate or to switch on and off a pot recognition system to determine whether a pot is placed on the cooking surface or to switch on or off a main switch of the appliance or to block the main switch in the switched-off position. Furthermore, a control element in the form of a rotary knob, removably held by magnetic forces, is placed on the plate in the actuating panel. By turning the knob clockwise or anti-clockwise, adjusting pulses for turning up and turning down the heating power of a pre-selected hot plate are delivered by means of sensors of a control device arranged under the plate. Removal of the rotary knob is detected by a magnetically actuated switching device, arranged under the plate and designated here for example as a control element sensor, and switches off the main switch and thereby resets all the settings made via the control device. This is an important safety feature of this control unit. It is thus ensured quickly and clearly that nothing else can be switched on and there is no danger from the cooking surface. A disadvantage however is that the knob can be lost by being mislaid, or removed by a child and buried in the garden by the dog. The cooking surface cannot be used without the rotary knob.

A control arrangement for an electrical heating appliance and especially a cooking surface is known from the German Unexamined Laid-Open Patent Publication DE 44 19 866 A1. In this case, a glass ceramic cooking surface has a plurality of hot plates and a control device in the form of a control panel with a plurality of contact switches. Also provided are a control unit for evaluating the signals of the contact switches and a main switch. A removable control element is not provided in this case.

A control device for an electrical appliance and especially a glass ceramic cooking surface is known from European Patent Application EP 0 797 227 A2. In this case, a plurality of removable control elements in the form of rotary knobs are provided, each assigned to a hot plate. Removal of a rotary knob can actuate a switch which effects a galvanic separation. If the entire cooking surface is switched off in this case on removal of a knob, this is not particularly clear since there are still knobs present on the plate. However, if the entire cooking surface were only to be switched off after removing all the knobs, this would involve a very inconvenient operation which would probably only be undertaken occasionally for cleaning purposes.

The object of the invention is to provide a control unit according to the preamble of claim 1 which avoids the disadvantages of the known control units and especially enhances operating convenience.

This object is solved by the combination of features of claim 1. This solution has the advantage that even when the control element is not present, the appliance can be used, whereby the serviceability is increased substantially. This is primarily very important for a domestic cooker. However, the solution is not restricted to such an emergency. The control unit can be constructed such that even when the control element is present, the alternative operating mode can be selected according to personal preference. This also enhances operating convenience.

Preferably, as is inherently known, in order to adjust a plurality of working areas of the same type, for example, the respective power of a plurality of hot plates of an appliance, only one single first regulating device with a removable control element is present which gives clear control, particularly when the control unit otherwise possesses no other removable control element. More appropriately, in order to enhance the clarity and ensure operability at all times, all the other regulating elements, but at least the second regulating device or the second regulating devices and the change-over regulating device or the change-over regulating devices are constructed without operationally removable, detachable parts, e.g. as contact switches, in order to be permanently operable as long as they are in operation or supplied with energy. In the case of the control unit of a glass ceramic cooking surface, the sensors can be arranged out of sight under the glass ceramic plate and they can be switchable by contacting the plate at marked positions on their top.

According to a preferred embodiment, the second regulating device serves as a change-over regulating device in a multiple function, whereby the blocking device is initially released or overcome by its actuation and its function is changed over into the alternative operating mode with the change-over device. This enhances the operating convenience since only one regulating device needs to be actuated. The second regulating device can have a further regulating function, e.g., for selecting one of a plurality of working areas of the appliance, e.g. a hot plate, whose operating state can then be adjusted in the normal operating mode by means of the first regulating device and in the alternative operating mode by means of the second regulating device.

However, if the safety is to be increased, a third regulating device can be used as a change-over regulating device wherein the third regulating device preferably has another regulating function, e.g., for locking and unlocking an appliance main switch in the switched-off position. In this case, on removal of the control element, the control element sensor can switch over the third regulating device into the function as a change-over regulating device.

The blocking device can comprise a time switch which after persistent actuation of the change-over regulating device for a pre-determined time of 5 seconds, for example, brings about a release of the blocking device. This solution can be realised simply and cheaply.

According to an advantageous embodiment, a control element sensor can prevent switchover to the alternative operating mode as long as the control element is located in its position, which increases safety. However, notwithstanding this, an alternative operating mode can also be allowed when the control element is present, which enhances the operating convenience.

The control element sensor can respond to the removal of the control element of the first regulating device and bring about a switch-off of a main switch of the appliance and thus reset the settings, e.g. the power settings of hot plates. With the release of the blocking device, the main switch can be switched on, bypassing an on/off switch. The on/off switch can also preserve its normal function if the control element is missing, which increases the safety from unintentional operation.

More appropriately, a signal transmitter is provided via which the control device delivers a signal, e.g. a sound signal or a light signal, as soon as the blocking device was released. This can be an electroluminescent display which is used to display an operating state and after the blocking device has been released, flashes as a signal transmitter and is preferably arranged spatially adjacent to the actuating area of the second regulating element whereby it also indicates the next operating step.

The first regulating device can be used to adjust a more appropriately, safety-relevant operating state of at least one operating area of the appliance, preferably the power of at least one hot plate.

The invention is explained in detail below with reference to schematic drawings for an exemplary embodiment.

Figure 1:
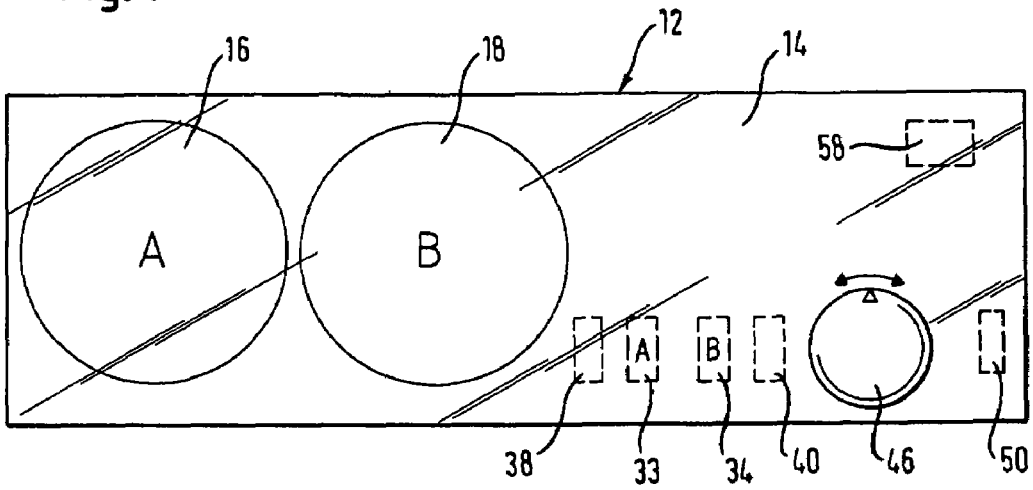
FIG. 1 is a plan view of a glass ceramic cooking surface.
Figure 2:
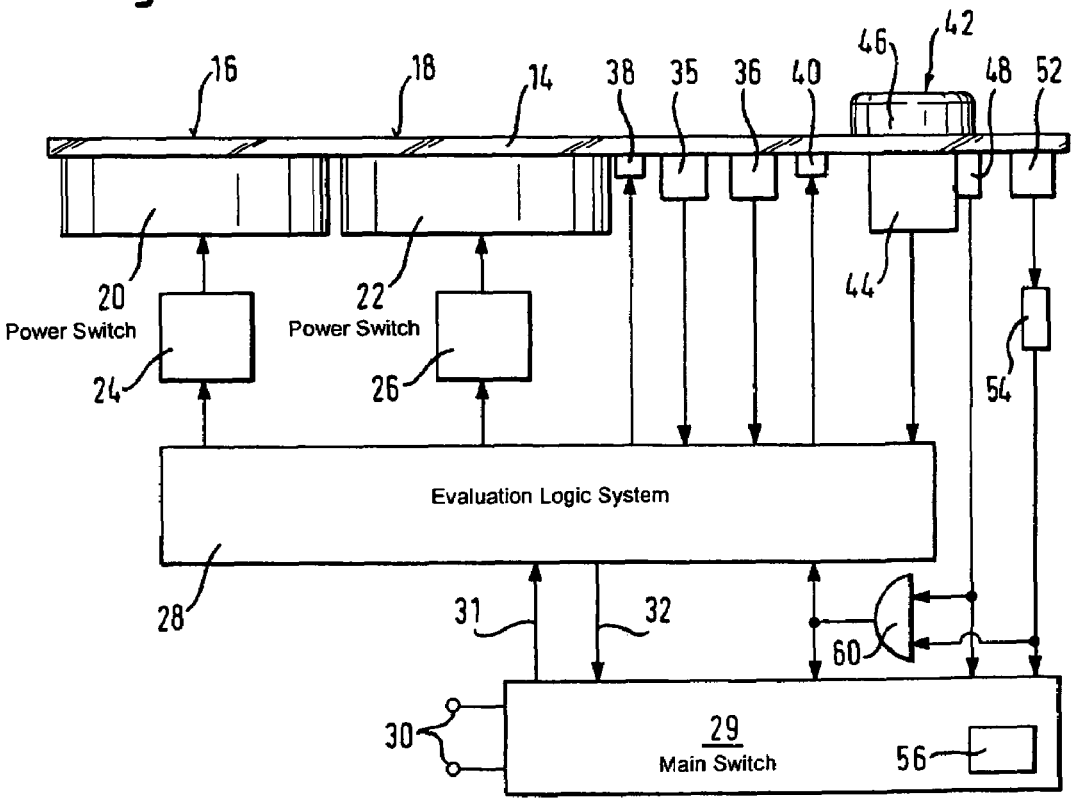
FIG. 2 is a view of the cooking surface from FIG. 1 seen from below in FIG. 1 or from the front in connection with a control device in a signal flow diagram and FIG. 3 is a view of a modified embodiment in accordance with that in FIG. 2.

The cooking surface 12 shown in FIGS. 1 and 2 has a glass ceramic plate 14 which is surrounded by a mounting edge not shown for building into a kitchen worktop. Marked on the plate 14 are two hot plates 16 and 18 which can be heated by heating devices 20 and 22 arranged under the plate. The power supply to the heating devices 20 and 22 is provided respectively via their own power switches 24 or 26 which is adjusted by an evaluation logic system 28 e.g. in the form of a programmable microcontroller. The power supply to the power switches 24 and 26 and the evaluation logic system 28 is provided via a main switch 29 and is not shown for simplicity. The main switch 29 has two connections 28 for a voltage supply and notifies its operating state via a control lead 31 of the evaluation logic system 28. The evaluation logic system 28 notifies its operating state to the main switch 29 via a response lead 32. The main switch 29 and the evaluation logic system 28 together form a control device.

In addition to the hot plates 16 and 18, two pre-selector touchpads 33 and 34 are marked on the plate 12 and arranged thereunder on the underside of the plate 14 are contact sensors in the form of selection sensors 35 and 36, serving as second regulating devices, which respond to contacts on the upper side and deliver a signal to the control device 28. Arranged adjacent thereto is respectively one electroluminescent display 38 or 40 which is controlled by the control device 28 and indicates the set heating power of the hot plates 16 or 18 through the plate 14. Furthermore, a regulating device 42 serving as a first regulating device is located on the plate 14. Said regulating device has a sensor 44 on the underside of the plate 14 which responds to a turning movement of a control element in the form of a rotary knob 46 arranged over the plate and when said rotary knob is turned clockwise or anticlockwise, delivers corresponding signals to the control device 28. A device for producing a force field, not shown, arranged on the underside of the plate 12, holds the rotary knob 46 removably in its position in a known fashion. Also located in the area below the rotary knob 46 is a control element sensor 48 which for example can have a reed switch which responds to a magnet arranged in the rotary knob 46 and notifies the control device or the main switch 29 whether the rotary knob 46 is present or not. Also marked adjacent thereto is a locking touchpad 50 having a locking sensor 52 arranged on its underside, which responds to contact of the touchpad 50 by the finger of an operator and delivers a signal to the main switch 29 via a time switch 54 into order to lock said switch in its switched-off position. The time switch 54 only delivers its signal after a 5-second persistent actuation of the locking sensor 52. The main switch can be actuated via an on/off sensor 56 which is arranged in a fashion not shown under a marked on/off touchpad 58 of the plate 14.

The signals from the control element sensor 48 and the locking sensor 52 are furthermore fed to an AND gate or AND switch 60 whose output signal is fed to the evaluation logic system 28 and the main switch 29.

In the normal operating mode the cooking surface 12 functions as follows: after releasing the interlock by actuating the locking touchpad 52 for 5 seconds and switching on the main switch 29 by means of the on/off touchpad 58, which of the hot plates 16 and 18 is to be adjusted is selected by touching one of the selector touchpads 33 or 34 with the finger. The relevant electroluminescent display 38 and 40 lights up and then indicates the power which is adjusted by means of the rotary knob 46. The same process can then be repeated for the other hot plate. If the control element in the form of the rotary knob 46 is removed during operation, the control element sensor 48 notifies this to the main switch 29 which thereupon shuts down the heating devices 20 and 22 via the power switches 24 and 26 and also resets the power settings.

The evaluation logic system 28 is set up or programmed as follows. When the control element sensor 48 notifies the main switch 29 that the rotary knob 46 is missing by means of a signal, in addition to switching off the heating power, the evaluation of the signal from the locking sensor 52 or that from the following time switch 54 is switched over. For this purpose, the signals from the control element sensor 48, if the control element or the rotary knob are missing, and from the locking sensor 52 are both fed to the AND switch 60 which delivers a signal when both are present. This signal switches on the main switch 29 and switches over the evaluation logic system 28 into the alternative operating mode. The signal processing of the signals from the selector sensors 35 and 36 serving as second regulating devices is then switched over so that in addition to pre-selecting the allocated hot plate 16 or 18, its heating power can be adjusted wherein the power can be turned up by touching the selector touchpads 30 or 32 with the finger or it can be continuously increased by permanent contact. If the maximum setting is exceeded, the counting begins from 0 again. Before adjusting the heating power, both electroluminescent displays 38 and 40 show the zero position and initially flash in order to draw attention to the changed operation and the next operating step. If the contact with the selector touchpads 33 or 34 persists for longer than 5 seconds, the hot plate is switched off again.

In the modification of the embodiment shown in FIG. 2, the output signal of the AND switch 60 can also be supplied alone to the evaluation logic system 29 to change this over. The cooking surfaces is then switched on via the on/off sensor 56 even if the rotary knob 46 is missing.

Figure 3:
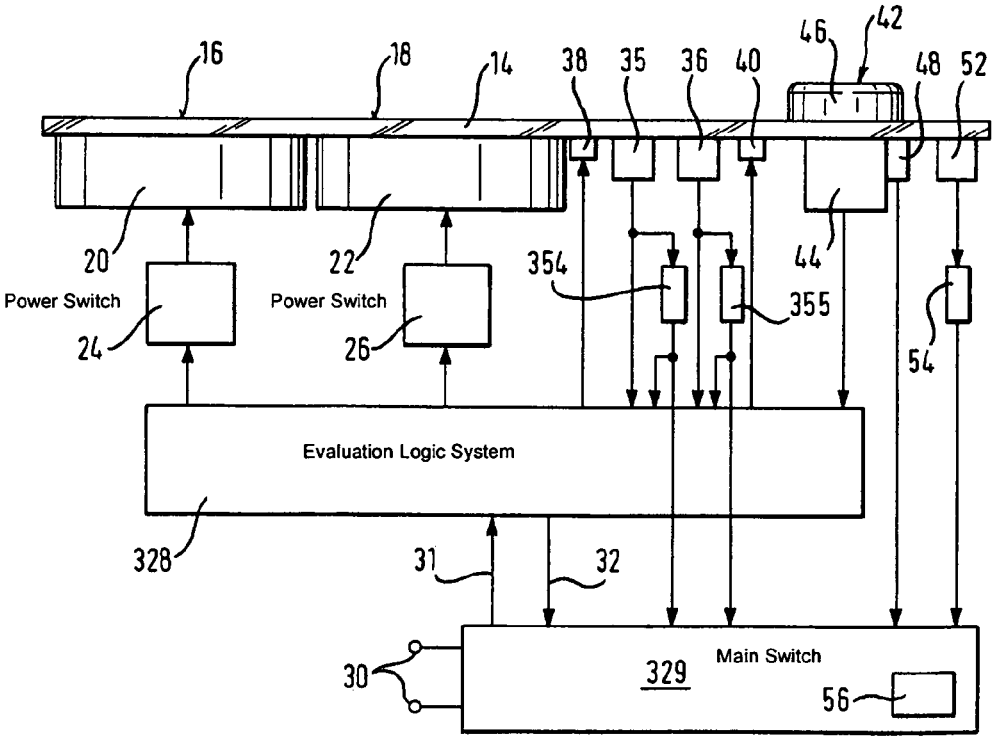

The embodiment shown in FIG. 3 largely corresponds to the embodiment according to FIGS. 1 and 2 and the same reference numbers are thus used for the same components as therein. The AND switch 60 according to FIG. 2 is missing here. Instead, the signals from the selector sensors 34 and 36 serving as second regulating devices are respectively fed directly to the evaluation logic system 328 to pre-select a hot plate and additionally to a blocking device in the form of a time switch 354 or 355. Its output signal which appears when the selector touchpads 33 or 34 are touched persistently for longer than 3 seconds, is fed on the one hand to the evaluation logic system 328 and there effects the switchover into an alternative operating mode. The output signal from the time switch 354 and 355 on the other hand is respectively also fed to the main switch 329 and switches this on.

The evaluation logic system 328 is set up or programmed as follows. The sensor 52 of the locking touchpad 50 and the control element sensor 48 do not interact with a changeover switch here but only have their functions described previously for the normal operating mode of the design according to FIGS. 1 and 2. Instead, in the present case the selector sensors 35 and 36 of the selector touchpads 30 and 32 take on further functions. If they are pressed for longer than 3 seconds and thus a blocking device formed by the time switch 354 or 355 was overcome, and at the same time one of the hot plates 16 or 18 was thereby selected, the selector sensor 35 or 36 is then to be used for adjusting the heating power of the corresponding hot plate 16 or 18 as described in the preceding exemplary embodiment. This function of the selector touchpads 30 and 32 with the relevant selector sensors 35 and 36 which serve as a second regulating device, is independent of the presence or absence of the rotary knob 46 of the first regulating device 42 and thus makes it possible to achieve not only emergency operation without the rotary knob 46 but also an alternative operating mode with the rotary knob 46 present.

The time switches 54 or 354 and 335 described in the exemplary embodiments as well as the AND switch 60 can be integrated into the evaluation logic system. The main switch 29 or 329 can at least be effectively actuated for switching off in the alternative operating mode via the on/off sensor. The locking sensor 52 can also be effectively actuated in the alternative operating mode without the rotary knob 46.

In the modification of the embodiment shown in FIG. 2, the signal from the locking sensor 32 can be fed to another time switch whose output signal is fed to another input of the main switch 29 in order to lock or to unlock said switch. This time switch has a shorter time constant e.g. 3 seconds, compared with the time switch 54 with 5 seconds in order to allow differentiation in the operation.

What is claimed is:

1. A control unit for a household or domestic appliance, comprising:

a control device;

regulating devices coupled to said control device for adjusting different operating states of said control device;

a first one of said regulating devices operated by a control element removable from the control unit;

a second one of said regulating devices adjusting the operating state of said control device for a normal operating mode operated by said removable control element and for an alternative operating mode operated without said removable control element;

said regulating devices include a changeover regulating device acting on said control device via a blocking device to switch over said control device into said alternative operating mode when said blocking device is released; and said second regulating device and said change-over regulating device are constructed as contact switches.

2. The control unit according to claim 1, including said second regulating device functions as said change-over regulating device.

3. The control unit according to claim 1, including the appliance including a plurality of working areas and a pre-selector switch, said second regulating device also functioning to actuate said pre-selector switch for selecting one of said plurality of working areas, said working area operating state can then be adjusted to said normal operating mode by said first regulating device and can also be adjusted to said alternative operating mode by said second regulating device.

4. The control unit according to claim 1, including a third regulating device serving as said change-over regulating device.

5. The control unit according to claim 4, including an appliance main switch and a control unit sensor and said third regulating device also functioning for locking and unlocking said main switch, said control unit sensor functioning as said change-over regulating device to switchover said regulating function to said alternative operating mode on removal of said control element.

6. The control unit according to claim 1, including said blocking device including a time switch which functions to release said blocking device after a predetermined time period of actuation of said change-over regulating device has elapsed.

7. The control unit according to claim 1, including a control unit sensor which prevents switchover into said alternative operating mode as long as said control element is not removed from said control unit.

8. The control unit according to claim 1, including an appliance main switch and a control unit sensor, said control unit sensor functioning as said change-over regulating device to switchover said regulating function to said alternative operating mode on removal of said control element and further to switch off said main switch during said switchover and to switch on said main switch when said blocking device is released.

9. The control unit according to claim 1, including a signal transmitter coupled to said control device for delivering at least one of a light or a sound signal when said blocking device is released.

10. The control unit according to claim 9, including said signal transmitter is an electroluminescent display for displaying an operating state and when said blocking device is released flashes a light signal indicating said alternative operating mode.

11. The control unit according to claim 10, including said second regulating device including an actuating area and said electroluminescent display is spatially arranged adjacent to said actuating area.

12. The control unit according to claim 1, including a plurality of working areas, including at least one hot plate, and said first regulating device adjusts the operating area of at least one of said working areas.

13. The control unit according to claim 1, including said first regulating device is a single regulating device including said removable control element.

14. The control unit according to claim 1, including an appliance main switch which is actuated at least for switching off in said alternative operating mode.

15. The control unit according to claim 14, including an interlocking device coupled to said main switch, which interlocking device also is actuated in said alternative operating mode.

* * * * *

UNITED STATES PATENT AND TRADEMARK OFFICE

CERTIFICATE OF CORRECTION

PATENT NO. : 6,998,585 B2
APPLICATION NO. : 10/897641
DATED : February 14, 2006
INVENTOR(S) : Klaus Erdmann It is certified that error appears in the above-identified patent and that said Letters Patent is hereby corrected as shown below:

On the Title Page, insert
Item --(63) Continuation of Application No. PCT/EP03/00508, filed on Jan. 20, 2003.--

Signed and Sealed this

Twentieth Day of May, 2008

JON W. DUDAS
*Director of the United States Patent and Trademark Office*

UNITED STATES PATENT AND TRADEMARK OFFICE

CERTIFICATE OF CORRECTION

PATENT NO. : 6,998,585 B2
APPLICATION NO. : 10/897641
DATED : February 14, 2006
INVENTOR(S) : Klaus Erdmann It is certified that error appears in the above-identified patent and that said Letters Patent is hereby corrected as shown below:

On the Title page please add

Item (30) Jan. 23, 2002 (DE) ..... 102 02 493.6

Signed and Sealed this

Twentieth Day of January, 2009

JON W. DUDAS
*Director of the United States Patent and Trademark Office*